United States Patent [19]

Simpson

[11] Patent Number: 4,639,213

[45] Date of Patent: Jan. 27, 1987

[54] CONFINED SPACED INFRARED BURNER SYSTEM AND METHOD OF OPERATION

[75] Inventor: Thomas W. Simpson, Rochester, Mich.

[73] Assignee: Solaronics, Inc., Rochester, Mich.

[21] Appl. No.: 682,538

[22] Filed: Dec. 17, 1984

[51] Int. Cl.[4] ..... F23D 13/12

[52] U.S. Cl. ..... 431/326; 126/92 R; 126/92 AC; 431/170

[58] Field of Search ..... 431/326, 328, 329, 170, 431/19; 126/92 R, 92 AC, 92 C, 21 A, 21 R, 91 A

[56] References Cited

U.S. PATENT DOCUMENTS

| | | | |
|---|---|---|---|
| 1,146,726 | 7/1915 | Lucke | 431/328 |
| 1,223,308 | 4/1917 | Bone et al. | 431/328 |
| 1,308,364 | 7/1919 | Lucke | 431/328 |
| 1,677,156 | 7/1928 | Vaughn | 126/92 C |
| 1,731,053 | 10/1929 | Lowe | 431/328 |
| 2,340,120 | 1/1944 | Grapp | 431/19 |
| 2,987,118 | 6/1961 | Brown | 431/328 |
| 3,090,371 | 5/1963 | Dasij | 126/21 A |
| 3,199,572 | 8/1965 | Boulet | 431/329 |
| 3,434,791 | 3/1969 | Hayashi et al. | 431/328 |
| 3,439,996 | 4/1969 | Lherault et al. | 431/328 |
| 3,463,139 | 8/1969 | Hayashi et al. | 431/328 |
| 3,468,298 | 9/1969 | Teague, Jr. et al. | 431/328 |
| 3,480,000 | 11/1969 | Torrey et al. | 126/21 A |
| 3,556,707 | 1/1971 | Hine, Jr. | 431/328 |
| 3,614,282 | 10/1971 | Gabor | 431/328 |
| 3,671,174 | 6/1972 | Reid, Jr. | 431/326 |
| 3,785,763 | 1/1974 | Bratko | 431/328 |
| 4,480,628 | 11/1984 | Simpson | 126/92 C |

*Primary Examiner*—Margaret A. Focarino
*Assistant Examiner*—H. A. Odar
*Attorney, Agent, or Firm*—Krass & Young

[57] ABSTRACT

An infrared heat device utilizing a ceramic burner tile operating in a confined combustion chamber. Inlet gas flow, metered by an orifice, is boosted as required by the air pressure provided in at least approximately Stoichiometric ratio to compensate for increased back pressure.

9 Claims, 11 Drawing Figures

CONFINED SPACED INFRARED BURNER SYSTEM AND METHOD OF OPERATION

INTRODUCTION

This invention relates to a gas-fired infrared heating devices and particularly to an apparatus for producing usable heat by operating an infrared burner device in a confined combustion chamber exhibiting a relatively high back pressure.

BACKGROUND OF THE INVENTION

It is now well known that heating devices which generate infrared radiation can be effective and efficient in certain applications; for example, a single jet burner can be connected to emit a high temperature effluent into a length of metal tubing which, because of the passage of the effluent therethrough, is heated to a temperature where it emits infrared radiation. The typical installation utilizes a burner which produces a relatively long high pressure flame front.

A second example of prior art infrared heating devices comprises a burner tile, usually ceramic, which exhibits a large number of small diameter channels or performations extending through the tile from one face thereof to the opposte face. A mixture of air and gas is supplied to a plenum on one face of the tile and is ignitied so as to burn substantially at the opposite face of the tile whereby the tile becomes heated and emits infrared radiation. This device is most often operated in the open atmosphere such that the pressure at the ignition-combustion surface of the tile and the air entry is essentially atmospheric. Stated another way, the combustion area for this device is essentially unconfined.

It has now become desirable to utilize the perforated tile ceramic burner in other than atmospheric conditions for a number of important reasons and cooking applications may be cited as a good example of such use. First, the combustion chamber can be isolated from the heat utilization chamber or chambers so that the effluent or flue gases of the combustion process do not contaminate the food or other materials being processed in the heat utilization chamber or chambers. Secondly, secondary atmospheric air or variations in the pressure thereof do not interfere with the strict ratios of air to gas that are required for efficient combustion and thus for high energy recovery from the consumed fuel.

SUMMARY OF THE INVENTION

In accordance with a first aspect of the invention a gas-fired infrared heating device is provided, which device comprises a burner plenum, a confined combustion chamber and a perforated burner tile which forms a sealed boundary between the plenum and the combustion chamber. In accordance with the invention means are provided for introducing a combustible air/gas mixture into the plenum at a hyper atmospheric pressure which is adjusted so as to be in a balanced relationship with the back pressure in the combustion chamber such that ignition and combustion of the air/gas mixture flowing from the plenum to the combustion chamber through the tile occurs substantially at the face of the tile which addresses the combustion chamber.

In accordance with the second aspect of the invention a process or method is provided for operating a gas-fired infrared heating device having a perforate burner tile disposed between a plenum and a combustion chamber and which essentially comprises the steps of:

A. introducing an air/gas mixture into the plenum at a pressure P1;

B. creating by a combustion and resulting gas expansion, a back pressure P2 in said chamber; and C. balancing P1 and P2 such that ignition and combustion of the air/gas mixture occurs substantially at the face of the tile which addresses the combustion chamber.

Further more detailed aspects of the invention will be apparent from a reading of the following specification.

DETAILED DESCRIPTION OF THE SPECIFIC EMBODIMENT

Figure 1:
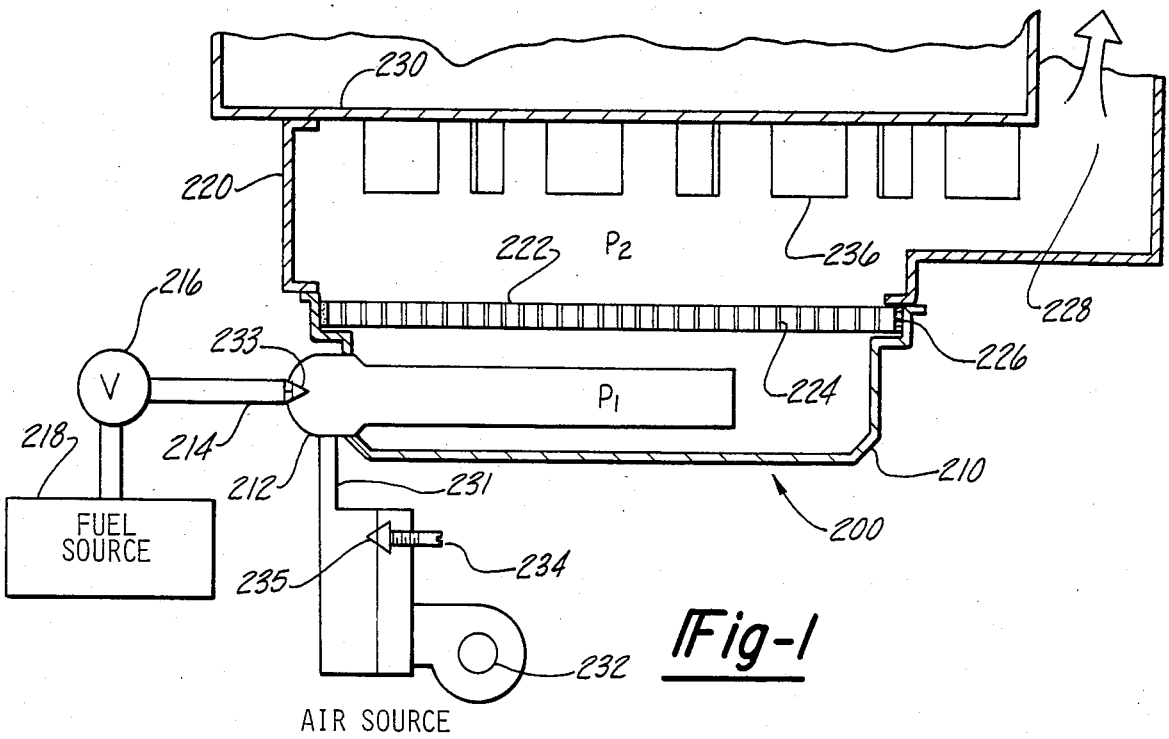
FIG. 1 is a partial sectional view of a heating device utilizing the present invention.

Referring first to FIG. 1 the invention is shown to comprise a heating device 200 comprising a stamped steel plenum housing 210 having mounted therein a gas/air mixing tube 212 for introducing an air/gas mixture in Stoichiometric ration into the plenum chamber. Gas is supplied by way of a line 214 which is connected through a regulating valve 216 to a supply 218 whereby the gas pressure may be regulated toward hyper atmospheric levels. Where supply gas pressures are known and operating gas pressures are predetermiend in accordance with the invention, the valve 216 may take the form of a fixed regulator device. Air is provided at hyper-atmospheric pressure by line 231 from a supply provided by pressurizing blower 232.

Plenum housing 210 is mechanically connected to a combustion chamber housing 220 by welding or other suitable means to form a relatively confined combustion chamber. The plenum chamber defined by housing 210 is separated from the combustion chamber defined by housing 220 by a rectangular ceramic burner tile 222 having opposite plane faces which address the plenum and the combustion chamber respectively. As shown in the drawing the burner has formed therein a relatively large number of small diameter performations or channels 224 which extend the full distance between the opposite plane faces and permit the air/gas mixture to flow from the plenum to the combustion chamber. A peripheral seal 226 prevents the air/gas mixture from traveling around the burner tile.

In accordance with the invention the combustion chamber housing 220 extends to and integrally includes a vent stack 228 which is contiguously adjacent to a heat utilization chamber defined by the wall 230 of a housing shown only in partial view in FIG. 1. The wall 230 is a common boundary between the combustion chamber and a heat utilization chamber and is provided with a number of metal fins 236 which extend into the combustion chamber to increase heat transfer between the combustion chamber and the heat utilization chamber. As will be hereinafter made more clear, the heat utilization chamber may, for example, be or include a circulating air path for a food cooking oven, an oil chamber for a deep fryer or such other heat utilization device as may be desired for the specific application of the subject invention. The exhaust stack 228 preferably remains in intimate thermal contact with the heat utilization chamber for as far as possible in order to increase the efficiency of the heat transfer from the effluent in the combustion chamber to the heat utilization chamber through the heat conductive wall 230 which forms a common boundary between those two chambers or zones.

In accordance with the invention, gas is admitted via line 214 to the mixing tube 212 at hyper-atmospheric pressures and air from line 231 also at hyper-atmospheric pressure. The gas flow rate is fixed by orifice 233 while the air flow rate is adjusted by screw 234 and cone 235. With the fixed gas flow rate provided by orifice 233 and regulating valve 216, the air is adjusted to give Stoichiometric combustion or as near it as practical by monitoring carbon monoxide and carbon dioxide levels in the flue gases. The compensating pressure to offset the combustion chamber pressure P2 is provided by the hyper-atmospheric gas pressure combined to give pressure P1 is such that despite the back pressure P2 the air/gas mixture again burns immediately at the surface of tile 222 which addresses the combustion chamber. Pressure which is too high produces flame "lift-off" which is undesirable as it lowers the temperature of the burner tile 222. Pressure which is too low is undesirable as it may permit the flame to travel backward through the burner tile performations 224 and cause a flash effect in the plenum housing 210. The balancing or adjusting of the air/gas pressures and ratio is typically done, as described above and may be monitored by observing the color of the tile over the combustion surface thereof as will be apparent to those skilled in the art.

Referring now to FIGS. 3 through 9 a detailed description will be given with respect to an application of the invention to a portable oven.

Referring to FIGS. 3 through 9, there is illustrated a portable oven 10 which in the disclosed embodiment is mounted to casters 12 so that the oven can be easily moved from one place to another. This capability allows food to be heated and cooked in one location and served in a separate location remote from the position in which the food is cooked.

The oblong shaped oven 10 is divided into two segments or portions, a heating unit 14 and a cooking or warming unit 16. The cooking unit 16 defined a chamber bounded on three sides by walls and on a fourth side by a hinged door 18 with a latch 20 for opening and closing the door. The bottom of the cooking unit 16 is closed while the top is open so that either the heating unit 14 or an insulating cover (not shown) enclosed the top of the heating chamber.

Figure 2:
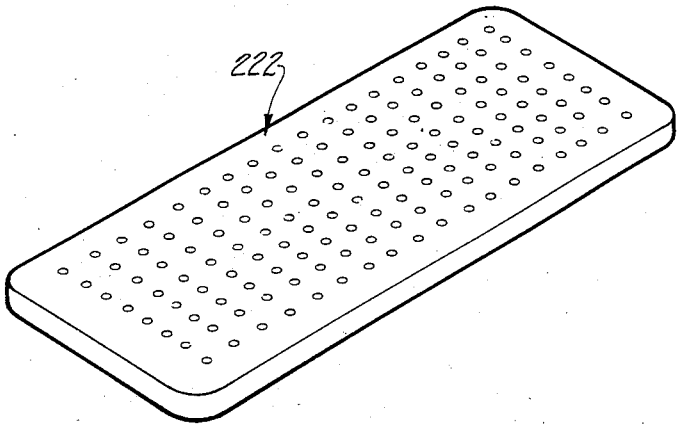
FIG. 2 is a perspective view of a burner tile in the combination of FIG. 1.

The temperature of air inside the chamber is elevated by a source of heat energy mounted inside the heating unit 14. In the preferred embodiment of the invention the source comprises a gas fired infrared burner 30 (see FIGS. 1–3 with the understanding that assembly 200 of FIG. 1 is comparable to assembly 30 of FIGS. 4 and 5) which heats air inside the heating unit 14 for delivery to the chamber inside the cooking unit 16. A control panel 24 enables the oven user to control the temperature of the oven as well as the time duration cooking takes place.

One feature of the disclosed apparatus is that the heating unit 14 is removable from the cooking unit 16. Once food inside the cooking unit 16 has been cooked, the heating unit 14 can be removed and replaced with an insulating top (not shown) which maintains food inside the cooking unit 16 at an elevated temperature as the oven portion is moved to a location where the food is to be served.

Figure 3:
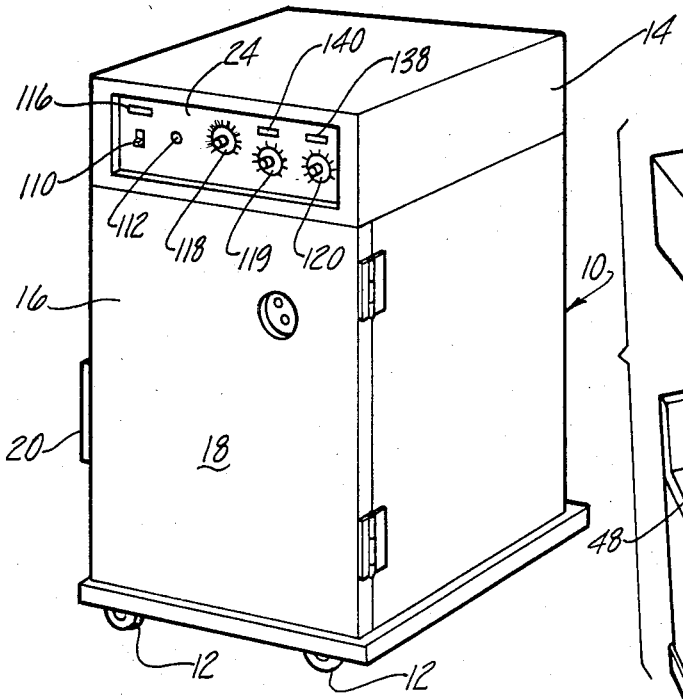
FIG. 3 is a perspective view of an oven including a detachable heating unit.
Figure 4:
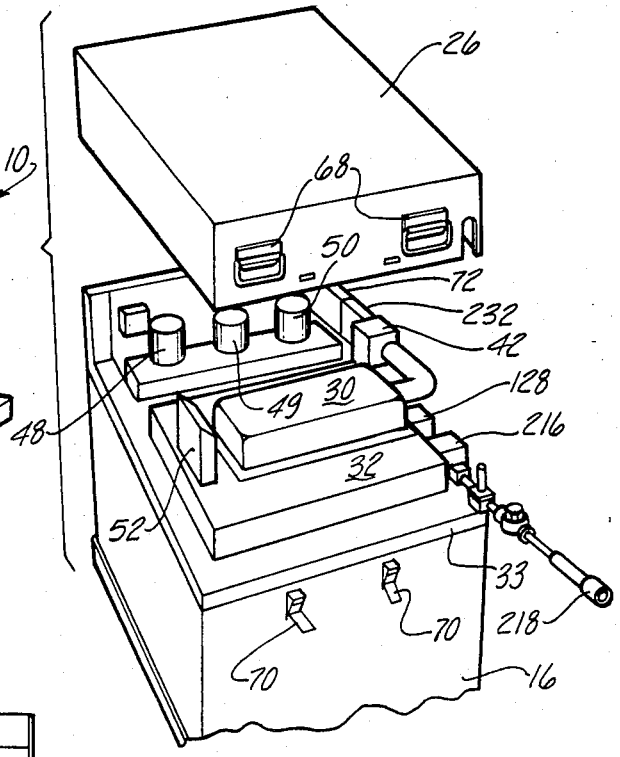
FIG. 4 is an enlarged perspective view of the oven of FIG. 3 with a top cover removed to show the elements of the heating unit.
Figure 5:
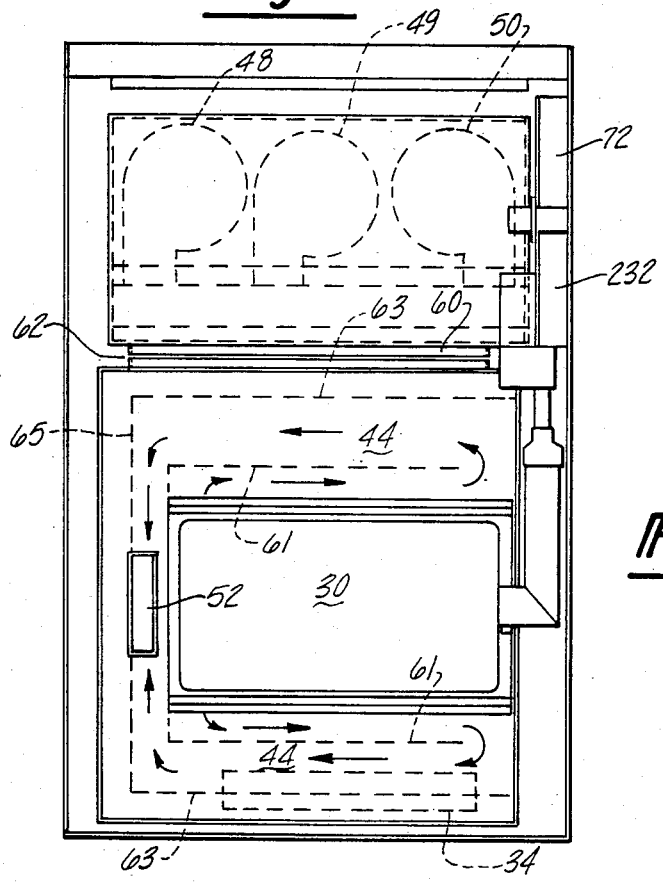
FIG. 5 is a planned view of the heating unit with certain elements shown in outline only.
Figure 6:
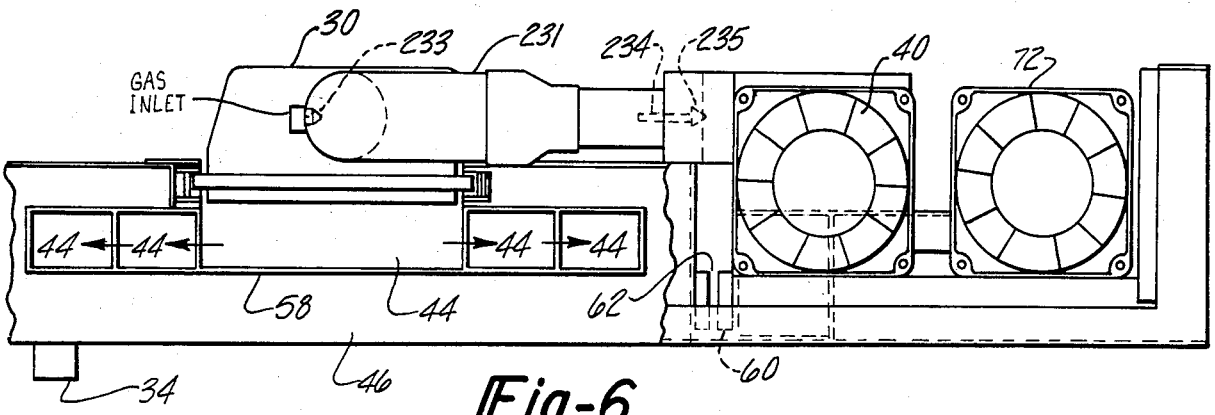
FIG. 6 is a partially sectioned elevational view of the heating unit with heat fins mounted inside a heat exchanger.
Figure 7A:
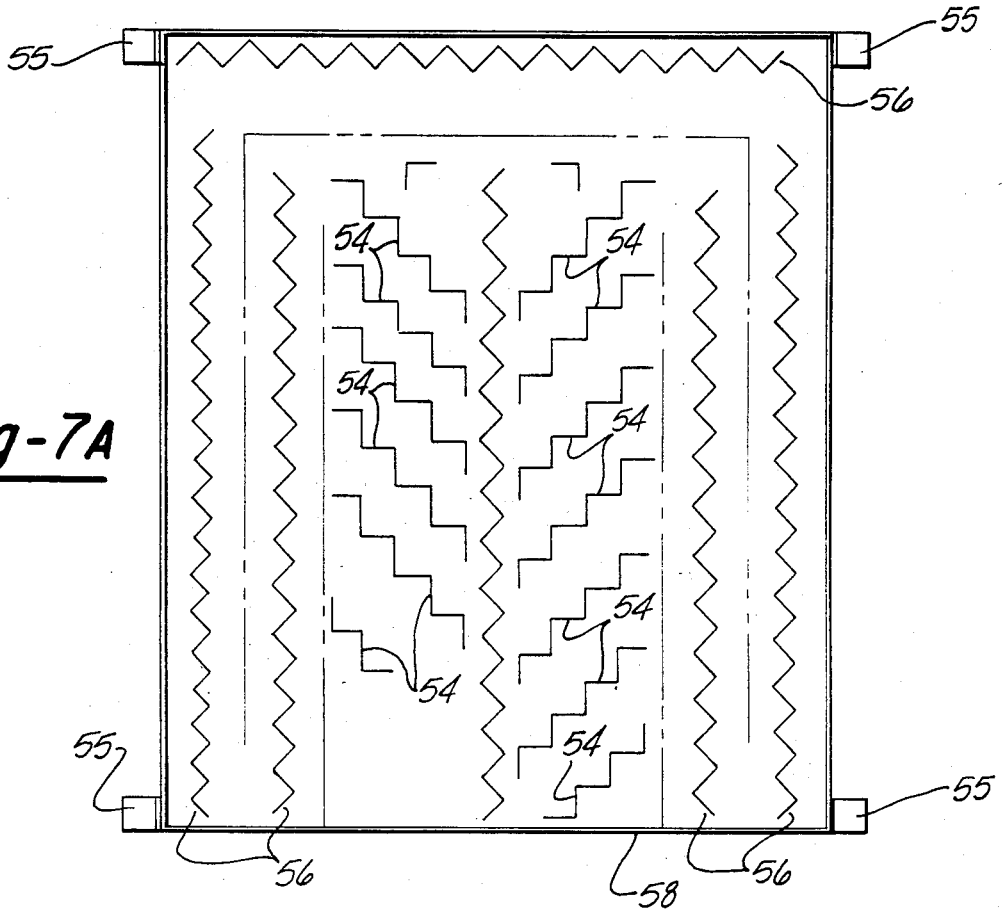
FIG. 7*a* is a top planned view of a heater plate assembly.
Figure 7B:
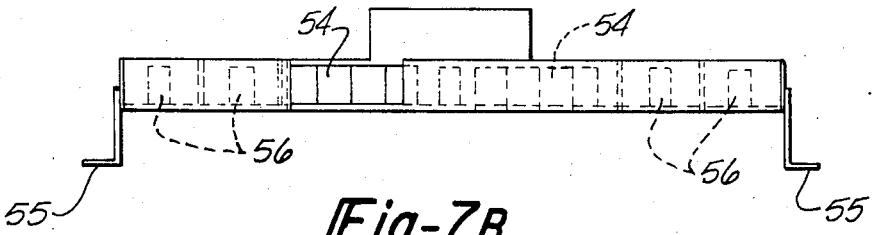
FIG. 7*b* is an elevational view of that portion of the plate with bottom heating fins deleted.

FIG. 3 shows the heating unit 14 with a cover 26 removed so that the interior of the heating unit can be viewed. The heating unit 14 comprises a burner 30 moutned on top of a heat exchanger 32 which directs heated air through a duct 34 to the heating chamber inside the oven. The preferred burner 30 comprises the gas-fired infrared burner shown in FIGS. 1 and 2 in which gas is routed into the burner via a gas coupling 218. The delivery or non-delivery of gas to the burner is controlled by a valve 216 which is opened and closed by a temperature controller to be described. A combustion fan 232 routes air through a duct 42 to provide oxygen to the burner 30 to burn the gas entering the burner.

The heat exchanger 32 supports the burner 30 and in turn is mounted to a bottom plate 33 of the heating unit 14. The exchanger defines first 44 and second 46 enclosures or heating zones through which heated air moves. The combustion fan 40 moves air through the first zone 44 and three circulating air fans 48–50 (see FIG. 4) move air through the second zone 46. The infrared gas burner 30 produces a waste product or effluent which is discharged into the air inside the first or top heating zone 44 and which is routed along a serpentine path to an exhaust duct 52. The combination of heated effluent and air is referred to as flue gas.

A metal plate 58 defines a boundary between the two zones 44, 46. A plurality of flue gas fins 54, 56 (see FIG. 7*a*) are mounted (by welding) to a top surface of the plate 58. A first grouping of these fins 54 are diagonally oriented with respect to the others 56 and are mounted directly beneath the burner 30. These fins 54 are heated by two heat transfer mechanisms in that they receive radiant energy from the burner 30 as well as receive heat by convection from the effluent produced during the combustion process. The remaining flue gas fins 56 are also welded to the common boundary 58 but are positioned to the sides of the burner. In a preferred embodiment of the invention, both groups of flue gas fins 54, 56 extend a height of approximately 1" above the boundary 58. This construction allows an efficient transfer of heat energy by the burner 30 to the plate 58 separating the first and second heating zones. The plate 58 is supported to a bottom of the heat exchanger with a number of mounting tabs 55.

In operation, the burner 30 directs radiant heat energy away from its bottom surface toward the first group of flue gas fins 54 as well as the plate 58. Up to about 50% of the heat caloric content of the gas used to fire the burner 30 is transferred to the plate 58. By directing the effluent to both groups of flue gas fins 54, 56 as well as the plate 58, an additional 20 to 30% of heat transfer of the original caloric content of the gas is achieved.

As noted above, the effluent is forced past the flue gas fins 54, 56, by the combustion fan 40 and directed to an exhaust duct 52 where it exits the rear of the heating unit 14. Prior to exiting the heat exchanger 32 the flue or combustion gases are routed along a winding path (see arrows in FIG. 5) defined by walls 61, 63, 65 bounding the first zone 44. As seen most clearly in FIG. 6 the first chamber is surrounded by the second chamber 46 so that the temperature of the flue gases has been reduced to approximately the temperature of the air inside the second chamber or enclosure 46 prior to reaching the flue exhaust duct 52.

The second heating zone or chamber 46 surrounds much of the first chamber 44 and defines a passageway through which air is routed by circulating air fans 48–50. The communication between the second heating zone or chamber 46 and the circulating fans 48–50 is through a duct. The construction of the heating unit 14 is such that the infrared burner 30 can be removed from the unit without necessitating a movement of the circulating fans 48–50. The duct 60 defines a ⅛" gap 62 which is sealed by a flexible ring, which in the preferred embodiment of the invention, comprises a Fiberfrax ring which is held in place by a steel clip (not shown).

As the common boundary or plate 58 between the two heating chambers 44, 46 heats up, the air inside the second chamber 46 comes in contact with the plate and is ehated by convection heating. The air which is forced through the second chamber 46 and out the duct 34 to the cooking unit 16. The exhaust or effluent from the burner 30 never reaches the second heating chamber 46 so that humidity and environmental control over the oven portion of the unit is possible.

Figure 8A:
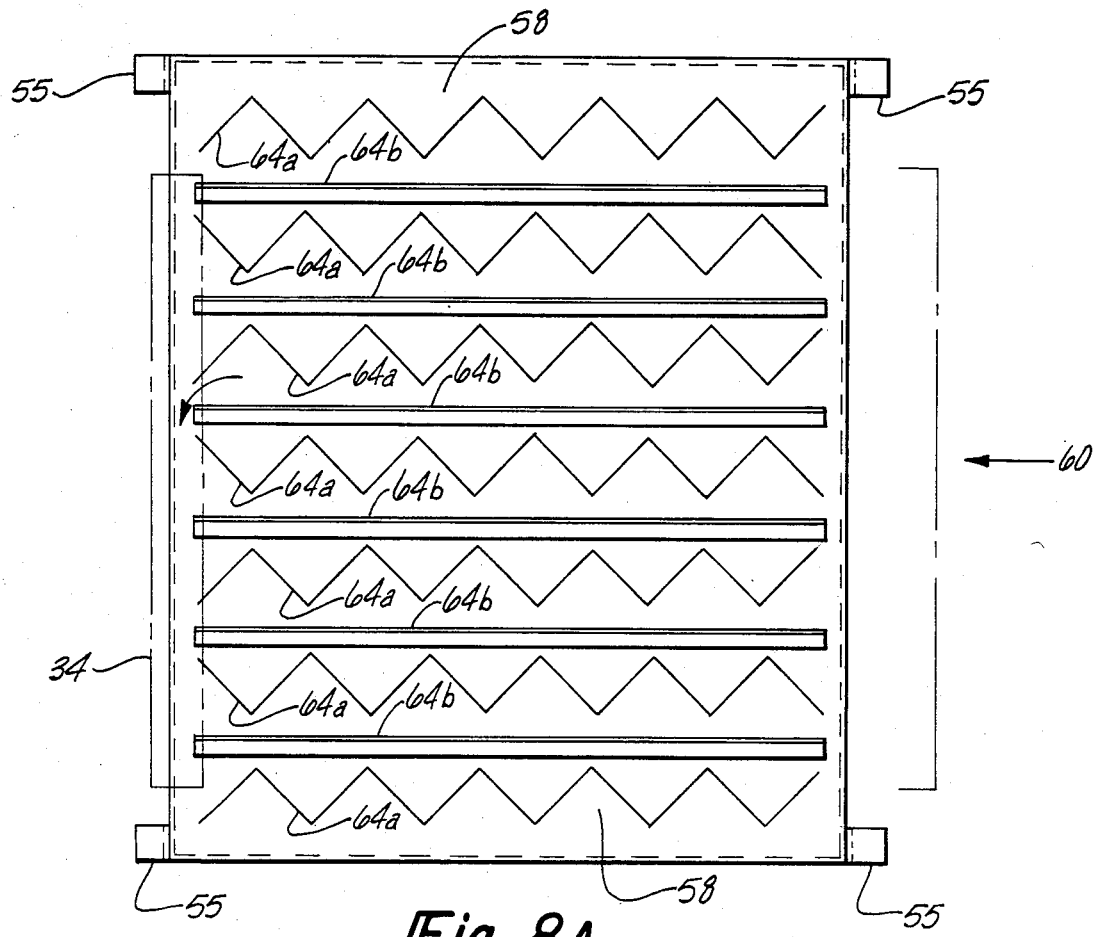
FIG. 8*a* is a bottom planned view of the heat exchanger plate.
Figure 8B:
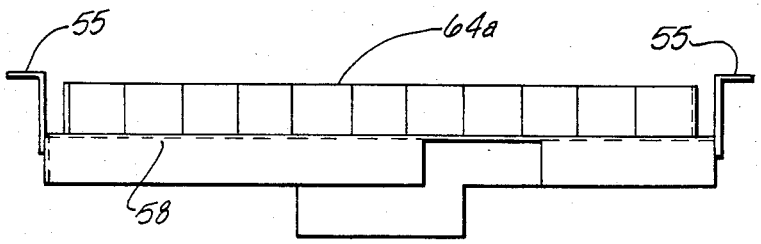
FIG. 8*b* is an elevational view of the plate with top heating fins deleted.

To improve the heat transfer characteristics of the heat exchanger 32, a plurality of metal hot air fins 64 are mounted (by welding) to the metal plate 58. Two different designs **64*a*, 64*b* for these hot air fins are utilized in the preferred embodiment of the invention. A first type of hot air fin 64*a* defines a zig-zag pattern across the width of the plate 58 (FIG. 8*a*). A second 64*b* of the hot air fin designs comprises an elongated member which extends between the zig-zag pattern fins across the width of the plate 58**. A preferred design includes six of the zig-zag design fins and six of the elongated fins.

The circulating air fans 48–50 force the air, which has been heated by convection contact with the hot air fins 64, through the hot air duct 34 to the oven chamber. The construction and design of the oven chamber is not critical for the present invention. Various designs are known in the art and so long as their exists a routing scheme through which the heated air can be forced into the oven, the present heat exchanger in combination with the radiant burner should prove to be an efficient mechanism of heating air within the unit.

This efficiency is enhanced if the oven chamber is itself insulated to avoid heat loss through the walls of the cooking unit 16. An inefficient design of the cooking chamber can offset the efficiencies of the heat exchanger and reduce the effectiveness of the present invention.

The disclosed heating unit 14 and cooking unit 16 define a closed air path to facilitate use of the oven 10 as a test oven. Air is directed from the fans 48–50 through the second zone 46 to the chamber inside the cooking unit 16 and back to the fans 48–50. the heated effluent from the burner 30 never interacts with this air and as long as the door 18 is not opened the interior of the oven chamber can be used as a test chamber.

As mentioned previously, the entire heating unit 14 can be separeted from the oven and replaced by an insulating cover which allows food inside the oven portion to remain heated as the oven is moved to a different location. The heating unit 14 has a cover 26 with two handles 68 which are held in place by a two latch mechanism 70 mounted to the cooking unit 16. The latching mechanism 70 can be readily loosened enabling the heating unit 14 to be lifted from the oven and replaced by the insulating top cover.

During the operation of the present heating unit, the circulating air fans 48–50 can overheat. An electrical area cooling fan 72 is mounted inside the heating unit 14 to direct cool air across the interior of the heating unit 14 and in particular across that portion of the heating unit where the circulating air fans 48–50 are located (See FIG. 5).

With the disclosed heat exchanger design, overheating of the fans 48, 50 is less of a problem since the hot gas from the burner is partially bounded by the cooler gas circulating through the oven. This feature in combination with the installation of one inch thick insulation of glass wool covered with aluminum foil over the heat exchanger allows the fans 48, 50 to be better cooled by fan 72. The combustion air fan is connected to the burner 30 by plenum box and duct 231. This plenum box houses the air adjustment cone 235 of FIG. 1.

Certain modificatons of the present unit could be made without changing the heating characteristics embodied by the heat exchanger 32. One possibility is to modify the design of the exhaust duct 52 to route flue gases through a duct along the interior of the cooking unit 16 to allow the heated air and effluent carried by this duct to be cooled to a temperature no higher than the temperature inside the oven. This design modification requires the hot air duct to experience one right angle bend and extend downward into the oven portion of the unit. It should be appreciated, however, that if the heating unit 14 is to be removable from the cooking unit 16, this hot air duct must be separable at the juncture where the duct passes from the heating unit 14 into the cooking unit 16.

Although not shown in the drawings, the construction and design of the present unit could be modified to include an insulating material around the exterior of the burner 30 to reduce the temperature of the heating unit. The addition of this insulation, however, would not change the performance of the heat exchanger which comprises a primary feature of the present invention.

It should also be appreciated that so long as the burner 30 produces a heated effluent which can be routed over the flue gas fins inside the first hot air chamber, the choice of the burner 30 is not critical to the invention. The preferred embodiment of the present invention utilizes a Model No. C131074 infrared gas fired burner, designed and manufactured by the Assignee of the present invention.

The preferred burner uses a spark ignitor which is mounted to a wall portion of the first heating chamber. An ignitor electrode 74 (shown schematically in FIG.

9) extends throough the wall portion to a position beneath the burner to provide a spark which ignites the burner. The present unit also comprises a flame probe to insure that the ignitor has succeeded in lighting the burner. A flame electrode 76 extends from the wall of the first heating chamber to the interior of the first heating chamber to a position beneath the burner 30. This flame electrode carries an alternating current signal, which a flame will rectify into a DC signal which in turn can be monitored to determine whether a flame exists.

The functioning of the heating unit 14 will be described in conjunction with a schematic representation of the control panel 24 and a wiring schematic shown in FIG. 9. The control panel 24 allows the oven user to adjust the oven temperature in both a roast condition and a holding condition. The user also controls how long the oven stays at the roast temperature before dropping to the lower holding temperature.

Figure 9:
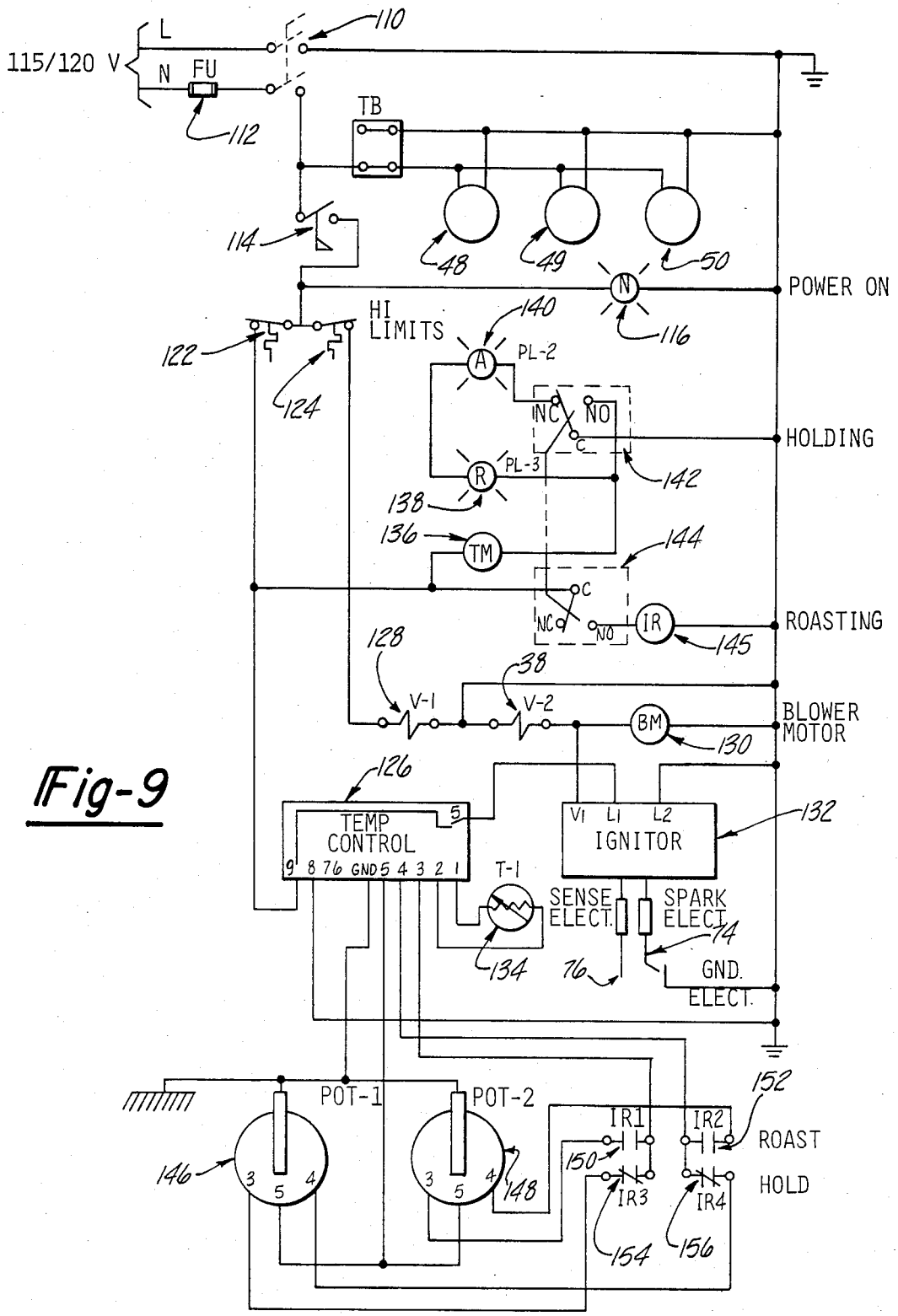
FIG. 9 is an electrical schematic showing the wiring of the components comprising the heating unit.

To initiate operation of the oven unit the user closes an on/off switch 110 which transmits 115 volt power to the circuit shown in the FIG. 9 schematic. Overload current conditions are avoided by a fuse 112 between the line voltage and the switch 110. The three dials 118–120, seen to the right of the fuse 112 in FIG. 3, allow the user to adjust the time period the oven is to maintain itself in a roast condition, allow the use to adjust the temperature of the oven in a so-called hold state, and allow the user to adjust the temperature in the roast condition.

Closing the switch 110 completes a circuit which energizes the circulating air fans 48–50 causing those fans to direct air through the closed path conduit leading through the heating unit to the oven. An air flow switch 114 senses the air flow produced by the fans 48–50. Unless the switch 114 senses that air flow, it remains open and the burner cannot light. Assuming this flow switch 114 senses an air flow through the oven, it closes causing a power-on light 116 to turn on indicating the fans are operating and the cooking unit 16 is ready to function.

Two high limit switches 122, 124 must close before the oven will light. The first of these switches 122 is coupled to pin 9 of a temperature control unit 126 to energize the temperature control unit. The first high limit switch 122 closes if the temperature in the oven is below 400° F. The second of the two high limit switches 124 closes if the temperature inside the oven is under 435° F. Once the switch 124 closes, a solenoid actuated valve 128 opens. It is seen, however, that this valve 128 is in series with the gas valve 38 so that no gas reaches the burner until this valve 38 is also opened. The valve 38 is opened at the same time a blower motor 130 in the fan 40 is energized to direct air from the combustion fan 40 to the burner 30.

The temperature controller 126 dictates when the burner is to light. Pin 5 of the controller 126 is coupled to terminal L1 of an ignitor 132. When terminal L1 receives a signal from the controller 126, it initiates a spark at the spark electrode 74 and simultaneously opens the valve 38 and energizes the blower motor 130. If a flame is sensed by the sensing electrode 76 within four seconds, the spark at the spark electrode is terminated and the burner 88 operates until a thermister temperature sensor 134 positioned inside the oven sends an indication to the controller 126 that the oven has been heated to a predetermined temperature. Once this occurs the contacts 7 and 5 on the temperature controller 126 open thereby closing the gas valve 38 until a next call for heat is received from the thermister 134. The temperature controller 126, ignitor 132, and thermister 134 are all available from the Fenwal Company under part nos. 19-404-007-100, 05-142401-001, and 28-230803-302 respectively.

In addition to transmitting power to the light 116, the air flow switch 114 energizes a timer 136, a roasting light 138, and a holding light 140. The roasting light 138 is energized whenever a roasting time up to a maximum of 14 hours has been set on the timer 136 by adjusting a knob 118 on the front panel 24. The timer 136 opens and closed two switches 142, 144 which dictate which of the two lights 138, 140 is energized as well as which of two potentiometer controls 146, 148 connected to the control dial 119, 120 determines the temperature inside the oven.

At any setting other than zero the timer 136 energizes the roasting light 138 and also energizes a relay 145 which closes normally open contacts 150, 152 to cause a second 148 of the two potentiometer controls to dictate oven temperature. The setting on this potentiometer is adjusted with the dial 120 on the panel 24. So long as the timer 136 indicates an unexpired roasting time, the potentiometer setting on the second potentiometer 148 is transmitted to temperature controller 126 which is turn through operation of the sensor 134 controls burner actuation in an on/off cycle.

When the timer times out, the switch 142 switches to energize the amber light 140 indicating that the oven is operating in a holding mode. The second switch 144 de-energizes the relay 145 so the normally open contacts 150, 152 now open and the normally closed contacts 154, 156 close. Closing of these two contacts transfers control of the oven temperature to a second potentiometer 146. The potentiometer 146 is connected to the dial 119 which the user has adjusted to choose a holding temperature. This temperature is maintained until the main switch 110 is opened to terminate oven operation.

To summarize operation of the oven, the user turns on the switch 110 and adjusts the timer, holding and roasting temperatures to a desired setting. When the timer 136 times out, the control of the oven temperature transfers from the potentiometer 148 to the holding potentiometer 146. Oven operation is terminated when the user opens the switch 110, which closes the valve 38 ending all burner operation.

Although the present design has been described with a degree of particularlity, it is possible that certain design modifications or alternations could be envisioned by a skilled artisan. It is the intent, therefore, that all such modifications or alternations falling within the spirit or scope of the appended claims be protected.

I claim:

1. A gas-fired infrared heating device comprising:

a burner plenum;

an air-gas mixer means for introducing a combustible air/gas mixture into the plenum at a pressure P1 which is greater than ambient pressure, said mixer means comprising first means for controlling gas flow, second means for providing air flow at above ambient pressure and third means for controlling air flow into the mixer means;

an enclosed but remote vented combustion chamber in which a back pressure P2 prevails, where P1 is greater than P2;

a thick, ceramic burner tile having a sufficient thickness to produce both a pressure and a temperature gradient, forming a sealed boundary between the plenum and the combustion chamber and having opposite faces thereof addressing the chamber and plenum respectively, the tile having formed therein a plurality a small diameter parallel channels extending between said faces and possessing a sufficient thickness to produce both pressure and temperature gradients between the faces thereof;

said first and third means being set such that the difference between P1 and P2 results in ignition and stoichiometric combustion of the air/gas mixture flowing from the plenum to the chamber via the channels substantially at the face of the tile which addresses the chamber;

whereby heating the tile to infrared emitting temperature occurs.

2. Apparatus as defined in claim 1 wherein the combustion chamber includes a wall which forms a heat transfer boundary between the combustion chamber and a heat utilizing chamber.

3. Apparatus as defined in claim 2 further including fins of high heat conductivity material mounted on said wall.

4. Apparatus as defined in claim 1 wherein said means for introducing a combustible air/gas mixture comprises a venturi-type mixing tube, means for regulating the flow of gas to said mixing tube, blower means, means for regulating the flow of air from said blower means to said mixing tube.

5. A method of operating a gas-fired infrared heating device having a thick, ceramic perforate burner tile defining parallel channels and having a sufficient thickness to produce both pressure and temperature gradients between the faces thereof disposed between a plenum and a remotely vented combustion chamber comprising the steps of:

A. utilizing an external blower, a presssurized gas supply and a venturi-type mixter tube to introduce and air/gas mixture into the plenum at a pressure P1 which is greater than ambient;

B. causing said mixture to flow through said channels in said tile to drop to pressure P2 in said chamber;

C. balancing P1 and P2 such that the ignition and stoichiometric combustion of the air/gas mixture occurs substantially at the face of said tile which addresses the combustion chamber thereby to heat said tile to infrared radiation emitting temperature; and D. exhausting the effluent of combustion from the combustion chamber at a point which is sufficiently remote from said chamber as to cause a pressure gradient between the combustion chamber and the point of exhaust.

6. A method as defined in claim 5 wherein the step of balancing is performed by adjusting P1 to a pressure greater than ambient pressure.

7. A method as defined in claim 5 further including the step of creating a flow of effluent from the combustion chamber to an exhaust vent.

8. A method as defined in claim 7 including the further step of utilizing heat created in the combustion chamber to heat a fluid in a second adjacent heat utilization chamber.

9. A method as defined in claim 8 in which the heat utilization step includes creating the flow of air through said second chamber.

* * * * *